United States Patent [19]

Kamp

[11] 4,221,109

[45] Sep. 9, 1980

[54] TRAVELING THREAD-JOINING DEVICE

[75] Inventor: Heinz Kamp, Rickelrath, Fed. Rep. of Germany

[73] Assignee: W. Schlafhorst & Co., Monchen-Gladbach, Fed. Rep. of Germany

[21] Appl. No.: 839,015

[22] Filed: Oct. 3, 1977

[30] Foreign Application Priority Data

Oct. 2, 1976 [DE] Fed. Rep. of Germany ..... 2644702

[51] Int. Cl.[2] ..... D01H 13/22; D01H 15/00

[52] U.S. Cl. ..... 57/22; 19/0.23; 57/81

[58] Field of Search ..... 57/1 R, 22, 23, 34 R, 57/58.89–58.95, 78, 80, 81; 19/0.23, 0.25; 340/259

[56] References Cited

U.S. PATENT DOCUMENTS

| | | | |
|---|---|---|---|
| 2,670,503 | 3/1954 | Anderson | 19/0.23 |
| 2,804,744 | 9/1957 | Breuning | 57/81 |
| 2,960,731 | 11/1960 | Hogg et al. | 19/0.25 UX |
| 3,673,591 | 6/1972 | Schwartz | 340/259 |
| 3,731,069 | 5/1973 | Goto et al. | 340/259 X |
| 3,908,347 | 9/1975 | Vignon | 57/81 X |
| 4,030,281 | 6/1977 | Schopper | 57/34 R X |

*Primary Examiner*—Donald Watkins
*Attorney, Agent, or Firm*—Herbert L. Lerner

[57] ABSTRACT

In a thread-joining device capable of traveling from spinning station to spinning station of a spinning machine having respective means for feeding sliver thereto, a device for measuring a dimension of the sliver at the respective feeding means of the spinning stations.

7 Claims, 2 Drawing Figures

TRAVELING THREAD-JOINING DEVICE

Figure 1:
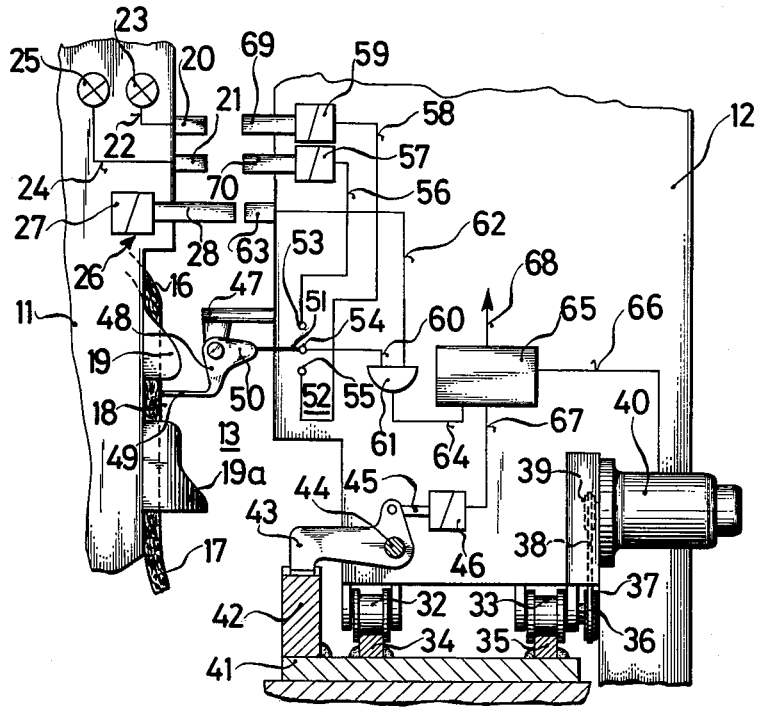

The invention relates to a traveling thread-joining or piecing device for spinning machines, especially rotor spinning machines.

There are many causes for thread breaks at spinning machines. Included therein are causes of thread breaks wherein, from the very start, a joining attempt of a traveling joining device cannot succeed. Such causes are when the sliver can runs empty, when there is an interruption in the sliver feed, when feed of a sliver having too great a cross section occurs, for example, in the form of a double loop, with externally non-visible interruption of the sliver feed in the interior of the spinning station housing.

It is accordingly an object of the invention to provide a traveling thread-joining device which is prevented from being activated from the very start in each of the foregoing cases.

With the foregoing and other objects in view, there is provided, in accordance with the invention, in a thread-joining device capable of traveling from spinning station to spinning station of a spinning machine having respective means for feeding sliver thereto, a device for measuring a dimension of the sliver at the respective feeding means of the spinning stations. Such a measuring device can advantageously block the thread-joining mechanism or permit the thread-joining device to travel farther if the measuring result affords the expectation of a purposeful thread-joining attempt.

In accordance with another feature of the invention, the thread-joining device includes means for actuating the measuring device during travel thereof for measuring the dimension of the sliver at the respective feeding means therefor.

The measuring device need not be constructed so as to determine exact or absolute dimension values. It is sufficient, in accordance with a further feature of the invention, to provide the measuring device with means for differentiating at least the sliver dimension "normal cross section", "greater than normal cross section" and "smaller than normal cross section or absence of sliver altogether".

In accordance with an added feature of the invention, the measuring device comprises mechanical sensing means displaceable on the sliver, and a channel member partly cut open for passage of the sensing means therethrough, the sliver being guidable in the channel member with established, substantially uniform dimensions. The sliver can be introduced, for example, from below toward the top into the spinning stations. As it travels past the thread-joining device, sensing means slide on and along the sliver sled-like transversely to the feeding direction of the sliver. The sensing means can also be rollable on and along the sliver, for example in direction of feed thereof, so that the sliver cannot be braked by the sensing means in feeding direction. The channel members are cut open partly only to an extent that the sensing means can be guided measuringly over the sliver in the slot formed thereby.

In accordance with an additional feature of the invention, the mechanical sensing means are operatively connected to a three-position switch. The three switch positions correspond to the aforementioned three sliver characteristics that are to be determined. The traveling thread-joining device is constructed so that it is activated at a spinning station which has issued a demand for thread-joining only if the sliver has a normal dimension i.e. "normal cross section". Only then is there an adequately great likelihood that thread-joining attempts also will be successful.

In accordance with yet another feature of the invention, one of the positions of the three-position switch corresponds to the sliver dimension "less than normal cross section" and another of the positions thereof to the sliver dimension "greater than normal cross section", and means are included for effecting signal connections of the one and another positions of the switch to a signaling device at a respective spinning station. These signal connections need not always be present and it is sufficient that they be present only when the thread-joining device travels past the respective spinning station. The signal connections can accordingly be formed, for example, of electrical connections employing proximity switches. It is recommendable to provide two signaling or indicating devices at each spinning station, one of which is responsive to the signal "smaller than normal cross section" and the other to the signal "greater than normal cross section". In a somewhat more simplified construction, one signaling or indicating device is sufficient and, correspondingly, only one signal connection for each spinning station.

In accordance with a concomitant feature of the invention, the third of the positions of the three-position switch corresponds to the sliver dimension "normal cross section", and the thread-joining device includes a travel-mechanism motor for driving the thread-joining device, means for switching off the motor and simultaneously starting a thread-joining program of the thread-joining device, pawl means actuatable by the operative connection through the three-position switch to the mechanical sensing means of the measuring device for switching off the motor and starting the thread-joining program only when the switch is in the third position thereof and a signaling or indicating device at the respective spinning station signals or indicates "thread-joining required". This operative connection is also required to be present only when the thread-joining device travels past the respective spinning station. Also in this case, proximity switches, for example, can be employed.

The advantages derived from the invention are especially that superfluous thread-joining attempts can be obviated from the start, the sliver-measuring device being provided only once for a major section of the spinning machine, namely as a part of the automatic thread-joining device.

Other features which are considered as characteristic for the invention are set forth in the appended claims.

Although the invention is illustrated and described herein as embodied in a traveling thread-joining device, it is nevertheless not intended to be limited to the details shown, since various modifications and structural changes may be made therein without departing from the spirit of the invention and within the scope and range of equivalents of the claims.

Figure 2:
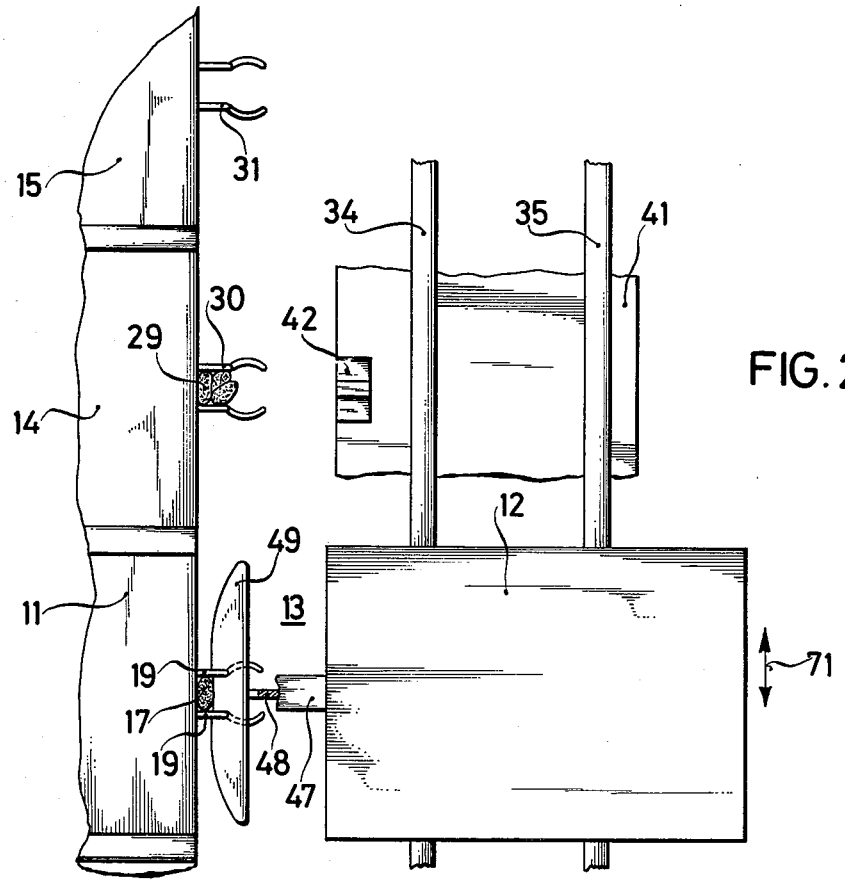

The construction and method of operation of the invention, however, together with additional objects and advantages thereof will be best understood from the following description of specific embodiments when read in connection with the accompanying drawings, in which:

FIG. 1 is a diagrammatic fragmentary side view of a spinning station and a traveling thread piecing or joining device that has become engaged therewith, and further showing schematically a block circuit diagram of a measuring device associated therewith and constructed in accordance with the invention; and FIG. 2 is a top plan view of FIG. 1 showing also two spinning stations located adjacent to the spinning station shown in FIG. 1.

Referring now to the drawing and first, particularly, to FIG. 1 thereof, there is shown a spinning station 11 and a traveling thread piecing or joining device 12 that has stopped in front of the spinning station 11 and has clicked into suitable engagement therewith. A block diagram of a measuring device 13 constructed in accordance with the invention is also illustrated in FIG. 1.

As is further shown in FIG. 1, a sliver supply 16 for the spinning station 11 is provided with a sliver-guiding channel member or gutter 19, 19*a* having a notch 18 formed therein. Two proximity switches 20 and 21 are, furthermore, provided at the spinning station 11. A line 22 leads from the proximity switch 20 to a signaling device 23, and a line 24 from the proximity switch 21 to another signaling device 25. The signaling device 23 serves for signaling "sliver cross section too small" and the signaling device 25 "sliver cross section too large" to the servicing or operating personnel. Another signaling device 26 formed of an electromagnetic drive 27 with a switching armature 28 serves to signal "joining or piecing required" to the joining or piecing device 12.

In the somewhat simplified top plan view of the spinning stations 11, 14 and 15 according to FIG. 2, it is apparent that the sliver 17 at the spinning station 11 has a normal cross section, the sliver 29 has run into the channel 30 of the spinning station 14 with approximately three times the normal cross section, such as that of the sliver 17, and the channel 31 of the spinning station 15 contains no sliver at all.

The piecing or joining device 12, which is of conventional construction and requires no detailed description herein since the specific construction thereof forms no part of the invention of the instant application, has two sets of supporting drive rollers 32, 33 disposed on rails 34, 35. The one drive roller 33 has a shaft 36 which carries a gear 37 that is connected by an endless chain 38 to another gear 39 which is seated on a driven shaft of a travel-mechanism motor 40.

A support beam 41 on which the rails 34, 35 are fastened has a stop or detent 42 located in front of the spinning station 11. Similar stops are also disposed in front of each of the other spinning stations. As shown in FIG. 1, a pawl 43, which is pivotable about an articulating joint or pivot pin 44 and is actuatable by a switching armature or plunger 45 of an electromagnet drive 46, is in engagement with the stop 42.

The measuring device 13 is articulatingly fastened to a bracket or console 47. It is formed of a lever 48 with a slide or cradle-like sensor 49 and another lever 50 with a contact vane 51. Depending upon the position or setting of the sensor 49, the contact vane 51 engages one of the three contacts 53, 54 and 55 of a three-position switch 52. A lead 56 extends from the contact 53 of the switch 52 to an electromagnet drive 57, and a lead 58 from the contact 55 to an electromagnet drive 59. A line or lead 60 extends from the middle contact 54 of the three-position switch 52 to an input of an AND-gate 61. Another lead 62 extends from a proximity switch 63 likewise to an input of the AND-gate 61. The output of the AND-gate 61 is connected by a line 64 to a switching device 65.

Since the sensor 49 of the measuring device 13 due to the relatively great projection thereof on both sides, has already determined the normal structure of the sliver 17, as shown in FIG. 2, even before the stop position has been reached, the contact vane 51 is already disposed on the contact 54 when the proximity switch 63 comes into the vicinity of the outwardly driven switching armature 28 of the electromagnet drive 27 as the piecing or joining device 12 travels past. Since, in this instant, a signal has reached the AND-gate 61 both over the lead 60 as well as over the lead 62, the AND-condition has been fulfilled, and the switching device 65 receives a command over the lead 64 to stop the travel-mechanism motor 40, to engage the pawl 43 with the respective stop and to start the conventional thread piecing or joining program. The command to stop goes over the lead or line 66 to the travel-mechanism motor 40, the pawl-engagement command over the line 67 to the electromagnet drive 46 of the pawl 43, and the start command for the piecing or joining program over the line 68 to a conventional non-illustrated program switching mechanism.

The electromagnet drives 57 and 59 are not switched on at the existing setting or position of the three-pole switch 52, and the switching armatures 69 and 70, respectively, of the electromagnet drives 57 and 59 are accordingly withdrawn. The proximity switches 20 and 21 have, therefore, not responded, and a disturbance or disruption signal is not received.

The course of the rails 34 and 35 along the spinning machine is apparent from FIG. 2. The piecing or joining device 12 travels in direction of the double-headed arrow 71.

There are claimed:

1. In a thread-joining device capable of traveling from spinning station to spinning station of a spinning machine having respective means for feeding sliver thereto, a device for measuring a dimension of the sliver at the respective feeding means of the spinning stations, said measuring device having supply channel means for guiding the sliver and having a cut out extending transversely to the travel direction of the sliver formed therein.

2. In a thread-joining device capable of traveling from spinning station to spinning station of a spinning machine having respective means for feeding sliver thereto, a device for measuring a dimension of the sliver at the respective feeding means of the spinning stations, said measuring device comprising mechanical sensing means displaceable on the sliver, and a channel member partly cut open for passage of said sensing means therethrough, said sliver being guidable in said channel member with established, substantially uniform dimensions.

3. Thread-joining device according to claim 2 wherein said mechanical sensing means are operatively connected to a three-position switch.

4. Thread-joining device according to claim 3 wherein one of the positions of said three-position switch corresponds to the sliver dimension "less than normal cross section" and another of the positions thereof to the sliver dimension "greater than normal cross section", and including means for effecting signal connections of said one and another positions of said switch to a signaling device at a respective spinning station.

5. Thread-joining device according to claim 4 wherein the third of the positions of the three-position switch corresponds to the sliver dimension "normal cross section", and including a travel-mechanism motor for driving the thread-joining device, means for switching off said motor and simultaneously starting a thread-joining program of the thread-joining device, pawl means actuatable by the operative connection through said three-position switch to said mechanical sensing means of said measuring device for switching off the motor and starting the thread-joining program only when said switch is in said third position thereof and a signaling device at the respective spinning station signals "thread-joining required".

6. Thread-joining device according to claim 2 wherein said mechanical sensing means have means for rolling the same on the sliver.

7. Thread-joining device according to claim 2 wherein said mechanical sensing means have slide-like means for sliding the same on the sliver.

* * * * *